US006701761B1

(12) United States Patent
Chang et al.

(10) Patent No.: US 6,701,761 B1
(45) Date of Patent: Mar. 9, 2004

(54) LOCK SYSTEM FOR VEHICLES AND THE LIKE

(75) Inventors: Roger N. H. Chang, Taipei (TW); Edward J. Cheng, Northbrook, IL (US)

(73) Assignee: Bauer Products, Inc., Grand Rapids, MI (US)

( * ) Notice: Subject to any disclaimer, the term of this patent is extended or adjusted under 35 U.S.C. 154(b) by 0 days.

(21) Appl. No.: 10/365,597

(22) Filed: Feb. 11, 2003

(51) Int. Cl.[7] ..... E05B 29/04; E05B 35/08

(52) U.S. Cl. ..... 70/337; 70/338; 70/340; 70/360; 70/369; 70/421

(58) Field of Search ..... 70/367–369, 371, 70/421, 337–343, 382–384, 360, 361

(56) References Cited

U.S. PATENT DOCUMENTS

| | | | | |
|---|---|---|---|---|
| 1,141,463 A | | 6/1915 | Hurd | |
| 1,805,891 A | | 5/1931 | Shinn | |
| 2,097,407 A | * | 10/1937 | Spinello | |
| 2,460,709 A | | 2/1949 | Navarro | |
| 3,095,726 A | | 7/1963 | Schlage | |
| 3,190,093 A | | 6/1965 | Schlage | |
| 3,563,071 A | | 2/1971 | Barger | |
| 3,998,080 A | | 12/1976 | Fane | 70/338 |
| 4,075,879 A | * | 2/1978 | Christopher | 70/337 |
| 4,630,457 A | * | 12/1986 | Kincaid et al. | 70/369 |
| 4,715,201 A | | 12/1987 | Craig | 70/369 |
| 4,976,123 A | * | 12/1990 | Ceron et al. | 70/369 |
| 5,119,654 A | * | 6/1992 | Ceron et al. | 70/369 |
| 5,182,929 A | | 2/1993 | Myers | 70/337 |
| 5,775,146 A | * | 7/1998 | Edwards et al. | 70/369 |
| 5,799,520 A | * | 9/1998 | Laabs et al. | 70/360 |
| 5,964,110 A | | 10/1999 | Crocco et al. | 70/369 |
| 6,382,006 B1 | | 5/2002 | Field et al. | 70/371 |
| 6,604,393 B2 | * | 8/2003 | Larsen et al. | 70/208 |

FOREIGN PATENT DOCUMENTS

| | | | | |
|---|---|---|---|---|
| DE | 2629332 | * | 1/1978 | 70/360 |
| GB | 2123474 | * | 2/1984 | 70/371 |

* cited by examiner

*Primary Examiner*—Lloyd A. Gall
(74) *Attorney, Agent, or Firm*—Price, Heneveld, Cooper, DeWitt & Litton, LLP

(57) ABSTRACT

A lock system is provided for vehicles and the like of the type having at least one closure. A lock housing is mounted adjacent the closure, and includes a lock barrel with an axial tumbler groove, a positioner shoulder adjacent an outer portion of the barrel and a keeper shoulder adjacent an inner portion of the barrel. A lock plug is closely received in the barrel for rotation between locked and unlocked positions, and includes a keyway and outwardly biased, radially shifting tumblers. A control key is inserted into the keyway to retract all of the tumblers except a positioner tumbler that engages the positioner shoulder to locate the lock plug in a first axial position in the barrel. When the control key is removed, an outer keeper tumbler is biased outwardly for abutting contact with the keeper shoulder. A dealer key is inserted into the keyway to retract all of the tumblers except the positioner and outer keeper tumblers to permit rotation of the plug between the locked and unlocked positions. A customer key is inserted into the keyway to retract all of the tumblers except the outer keeper tumbler, and shift the plug axially into a second axial position in the barrel, wherein an inner keeper tumbler is biased outwardly for abutting contact with the keeper shoulder, and the positioner tumbler is shifted into the tumbler groove to prevent rotation of the plug by the dealer key to provide customer security.

30 Claims, 12 Drawing Sheets

LOCK SYSTEM FOR VEHICLES AND THE LIKE

BACKGROUND OF THE INVENTION

The present invention relates to key locks, and in particular to a lock system for vehicles and the like.

Key locks for vehicles and the like are generally well known in the art. Recreational vehicles typically have a number of key locks to control access to various areas of the vehicle, such as access doors to the vehicle interior, closures for storage compartments, and the like. While such locks are often configured so that a single key fits all locks, a problem exists, particularly at dealer lots, showrooms and the like, in managing and tracking the numerous keys for the vehicles being offered for sale. A salesman will typically require access to all lockable areas of a vehicle to properly show the vehicle to a prospective buyer. Also, customers normally want to be shown numerous vehicles before making a final selection, such that the efficient and accurate management of the numerous vehicle keys involved presents a significant challenge.

While special master keys are sometimes used to access all areas of a number of different vehicles to facilitate showing and/or demonstrating the vehicles to prospective purchasers, the locks must be re-keyed when the vehicle is sold to provide the buyer with adequate security. Consequently, a lock system that provides customers and sales personnel with easy access to the lockable areas of a vehicle, yet can be readily converted to personalize the locks after the sale of the vehicle, would be advantageous and represent a significant advancement in the vehicle lock art.

SUMMARY OF THE INVENTION

One aspect of the present invention is a lock system for vehicles and the like of the type having at least one closure. A lock housing is mounted adjacent the closure, and includes a lock barrel with an axial tumbler groove, a positioner shoulder adjacent an outer portion of the barrel and a keeper shoulder adjacent an inner portion of the barrel. A lock plug is closely received in the barrel for rotation between locked and unlocked positions, and includes a keyway and outwardly biased, radially shifting tumblers. A control key is inserted into the keyway to retract all of the tumblers except a positioner tumbler that engages the positioner shoulder to locate the lock plug in a first axial position in the barrel. When the control key is removed, an outer keeper tumbler is biased outwardly for abutting contact with the keeper shoulder. A dealer key is inserted into the keyway to retract all of the tumblers except the positioner and outer keeper tumblers to permit rotation of the plug between the locked and unlocked positions. A customer key is inserted into the keyway to retract all of the tumblers except the outer keeper tumbler, and shift the plug axially into a second axial position in the barrel, wherein an inner keeper tumbler is biased outwardly for abutting contact with the keeper shoulder, and the positioner tumbler is shifted into the tumbler groove to prevent rotation of the plug by the dealer key to provide customer security.

Another aspect of the present invention is to provide a lock system for vehicles and the like of the type having at least one closure. A lock housing is mounted adjacent the closure, and includes a lock barrel with an axial tumbler groove, a positioner shoulder adjacent an outer portion of the barrel and a keeper shoulder adjacent an inner portion of the barrel. A lock plug is closely received in the barrel for rotation between locked and unlocked positions, and includes a keyway and outwardly biased, radially shifting tumblers. A first key is inserted into the keyway to retract all of the tumblers except a positioner tumbler that engages the positioner shoulder to locate the lock plug in a first axial position in the barrel. When the first key is removed, an outer keeper tumbler is spring biased outwardly for abutting contact with the keeper shoulder. A second key is inserted into the keyway to retract all of the tumblers except the positioner and outer keeper tumblers to permit rotation of the plug between the locked and unlocked positions. A third key is inserted into the keyway to retract all of the tumblers except the outer keeper tumbler, and shift the plug axially into a second axial position in the barrel, wherein an inner keeper tumbler is biased outwardly for abutting contact with the keeper shoulder, and the positioner tumbler is shifted into the tumbler groove to prevent rotation of the plug by the dealer key to provide customer security.

The present invention comprises a lock system that provides customers and sales personnel with easy access to the lockable areas of numerous vehicles, yet can be readily converted to personalize the locks of a specific vehicle after it is sold to provide the buyer with security. The lock system is quite durable, has reduced manufacturing costs, and an uncomplicated design. Furthermore, the invention is efficient in use, capable of a long operating life, and particularly well adapted for the proposed used.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
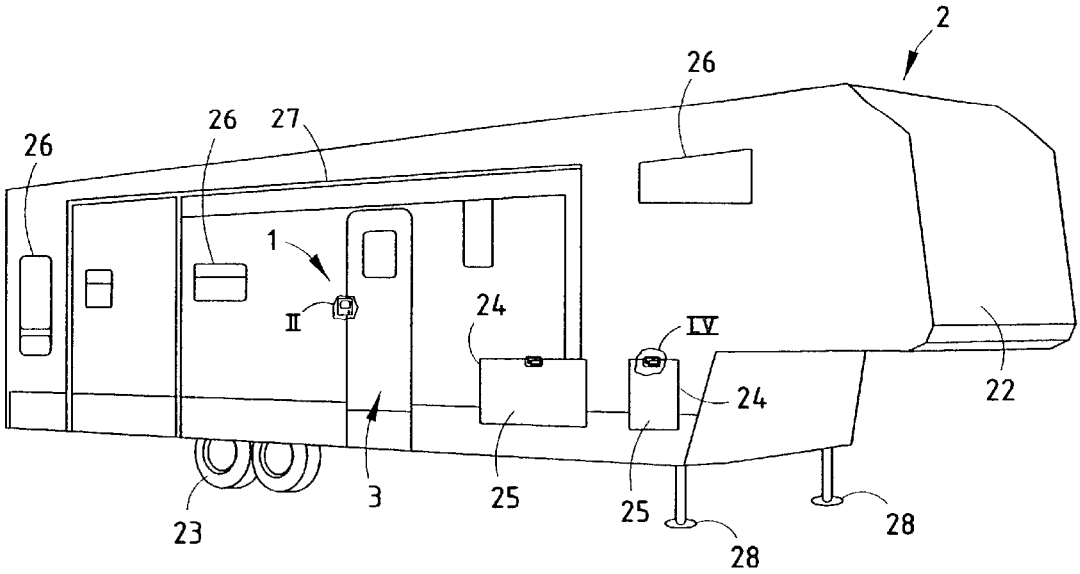
FIG. 1 is a perspective view of a vehicle incorporating a lock system embodying the present invention.
Figure 2:
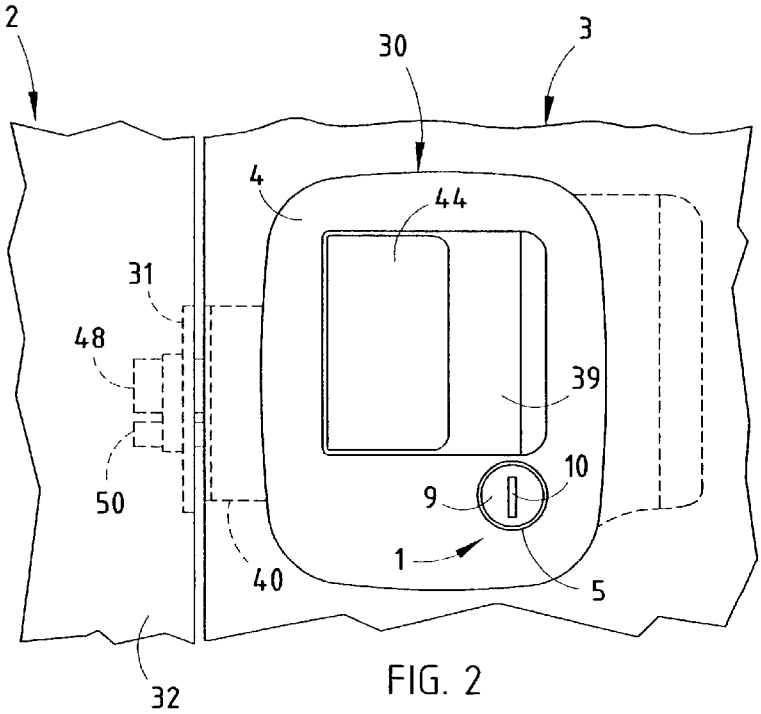
FIG. 2 is a front elevational view of a latch assembly, which incorporates the lock system, and is shown installed in an access door of the vehicle.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and process illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 47:
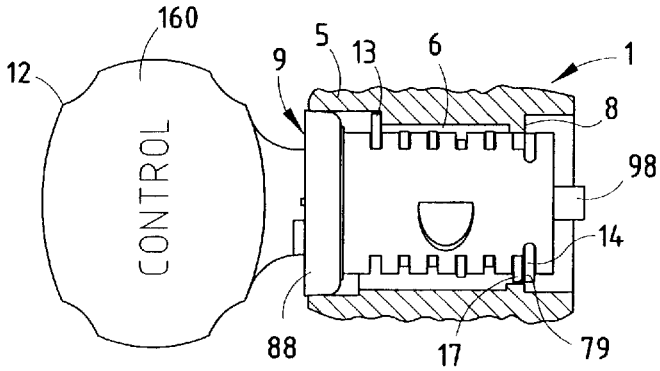
FIG. 47 is a side elevational view of the lock plug with the control key inserted therein, shown assembled in the lock barrel.
Figure 48:
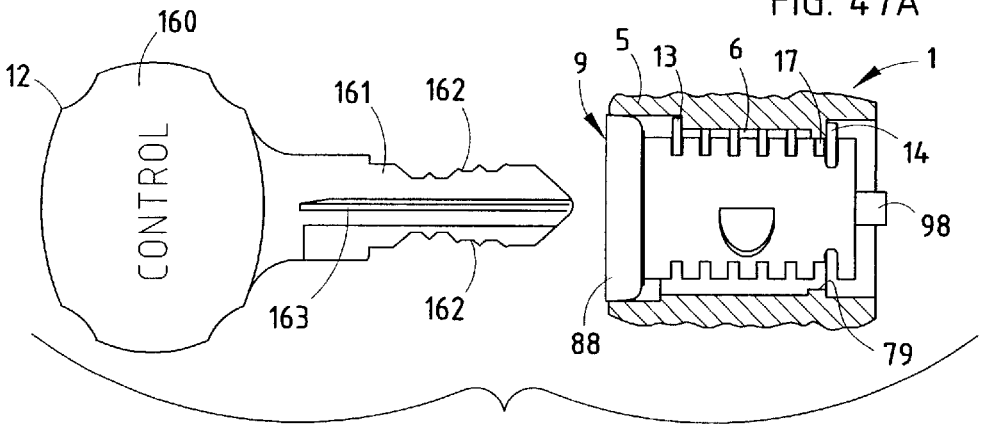
FIG. 48 is a side elevational view of the lock plug shown assembled in the lock barrel with the control key removed.
Figure 49:
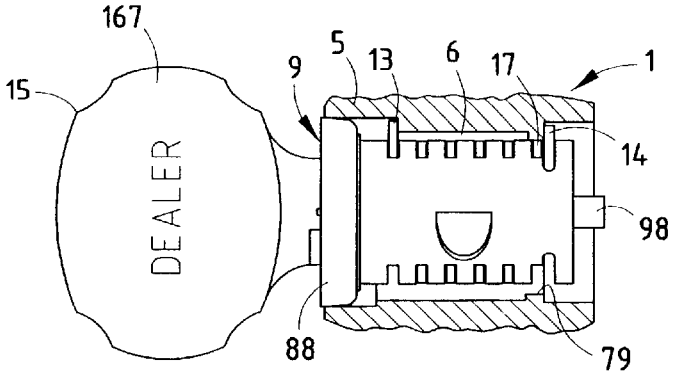
FIG. 49 is a side elevational view of the lock plug assembled in the lock barrel with the dealer key inserted into the lock plug, wherein the lock plug is shown in a first axial position within the lock barrel.
Figure 50:
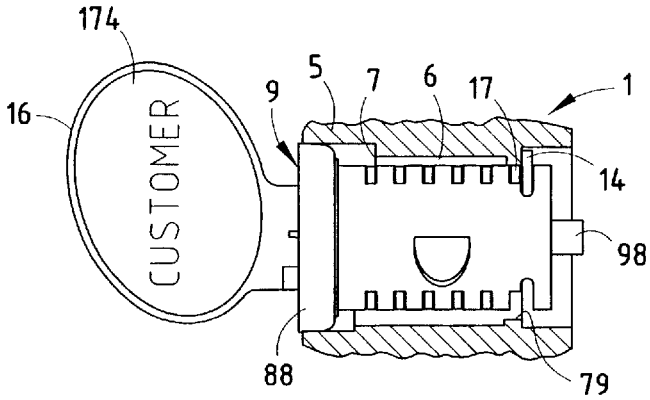
FIG. 50 is a side elevational view of the lock plug assembly in the lock barrel with the customer key inserted into the lock plug, wherein the lock plug is shown in a first axial position within the lock barrel.
Figure 51:
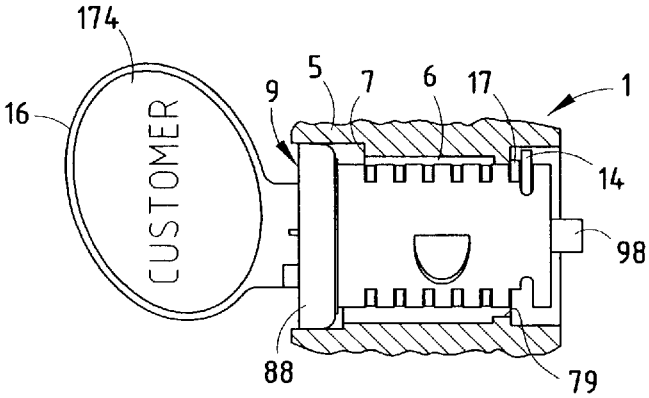
FIG. 51 is a side elevational view of the lock plug assembled in the lock barrel, with the customer key inserted into the lock plug, wherein the lock plug is shown in a second axial position within the lock barrel.
Figure 51A:
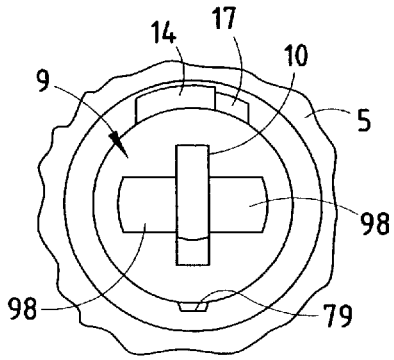
FIG. 51A is an end elevational view of the lock plug and lock barrel shown in FIG. 51.

The reference numeral 1 (FIGS. 1 and 2) generally designates a lock system embodying the present invention, which is particularly adapted for use in conjunction with vehicles and the like, such as the illustrated recreational vehicle 2 of the type having at least one entry closure or door 3. A lock housing 4 is mounted adjacent door 3, and includes a lock barrel 5 (FIGS. 5–11) with an axially extending tumbler groove 6, a positioner shoulder 7 disposed adjacent an outer portion of barrel 5, and a keeper shoulder 8 disposed adjacent an inner portion of barrel 5. A lock plug 9 (FIGS. 22–32) is closely received in barrel 5 for rotation between locked and unlocked positions, and includes a keyway 10 and outwardly biased, radially shifting tumblers 11. A control key 12 is inserted into the keyway 10 of lock plug 9 to retract all of the tumblers 11 except a positioner tumbler 13 that engages the positioner shoulder 7 to locate lock plug 9 in a first axial position in barrel 5, as shown in FIG. 47. When control key 12 is removed from keyway 10, as shown in FIG. 48, an outer keeper tumbler 14 is biased outwardly for abutting contact with the keeper shoulder 8. A dealer key 15 is inserted into the keyway 10 of lock plug 9, as shown in FIG. 49, to retract all of the tumblers 11 except positioner tumbler 13 and outer keeper tumbler 14 to permit rotation of lock plug 9 between the locked and unlocked positions. A customer key 16 is inserted into the keyway 10 of lock plug 9, as shown in FIG. 50, to retract all of the tumblers 11 except outer keeper tumbler 14. Lock plug 9 is shifted axially into a second axial position in lock barrel 5, as shown in FIG. 51, wherein an inner keeper tumbler 17 is biased outwardly for abutting contact with the keeper shoulder 8, and the positioner tumbler 13 is shifted into tumbler groove 6 to prevent rotation of lock plug 9 by the dealer key 15, so as to provide customer security.

The illustrated recreational vehicle 2 is in the nature of a fifth wheel trailer having a body 22 supported on ground-engaging wheels 23. Trailer body 22 has at least one entry closure or door 3 to access the interior of trailer body 22. Furthermore, the illustrated trailer 2 includes a plurality of exterior storage compartments 24, each of which includes a closure or door 25, which preferably also incorporates a lock system 1 embodying the present invention. Other than lock system 1, the illustrated trailer 2 has a conventional construction, with windows 26, a fold up awning 27, and retractable support props 28. As will be apparent to those skilled in the art, lock system 1 may be used in a wide variety of different applications and environments.

Figure 3:
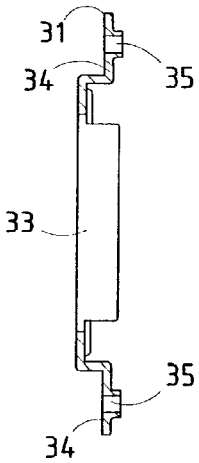
FIG. 3 is a vertical cross-sectional view of a striker plate portion of the latch assembly.
Figure 4:
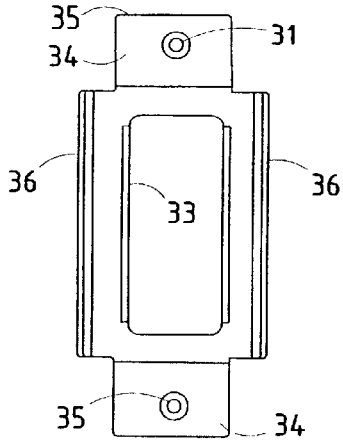
FIG. 4 is a front elevational view of the striker plate.
Figure 5:
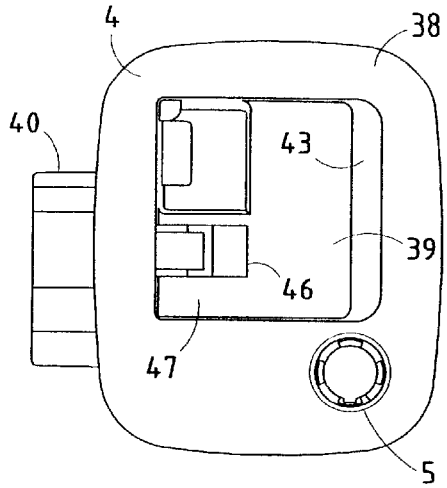
FIG. 5 is a front elevational view of a housing portion of the latch assembly.
Figure 6:
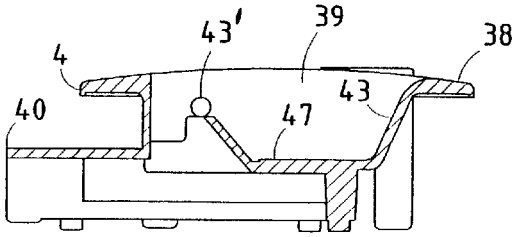
FIG. 6 is a horizontal cross-sectional view of the housing shown in FIG. 5.

In the example illustrated in FIGS. 2–21, lock system 1 is incorporated into a paddle latch assembly 30, wherein the lock housing portion 4 thereof is shown installed in the entry door 3 of trailer 2. Paddle latch assembly 30 includes a striker plate 31 (FIGS. 2–4) that is mounted in a frame 32 surrounding the opening in which entry door 3 is mounted. Striker plate 31 has a substantially rectangular front elevational configuration, and includes a central window 33 to selectively receive therein lock and latch portions of paddle latch assembly 30, as described in greater detail hereinafter. Striker plate 31 includes a pair of mounting flanges 34 which extend outwardly from the top and bottom of striker plate 31, and incorporates fastener apertures 35 to facilitate mounting striker plate 31 to the doorframe 32 in a horizontally aligned relationship with lock housing 4. Striker plate 31 also includes a pair of side flanges 36, which are received in a mating recess in doorframe 32.

Figure 7:
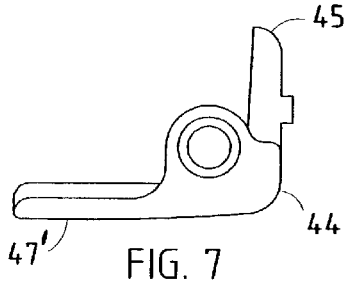
FIG. 7 is a top plan view of a paddle handle portion of the latch assembly.
Figure 8:
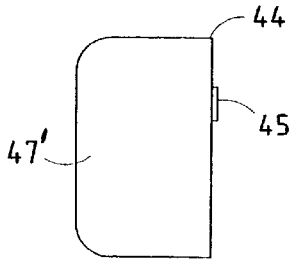
FIG. 8 is a front elevational view of the paddle handle.
Figure 9:
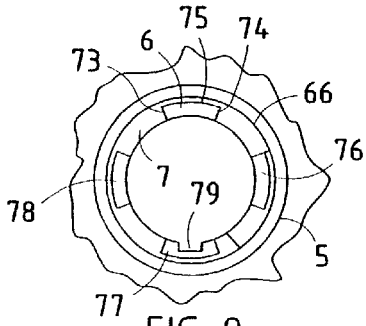
FIG. 9 is an enlarged, front elevational view of a barrel portion of the lock system.
Figure 10:
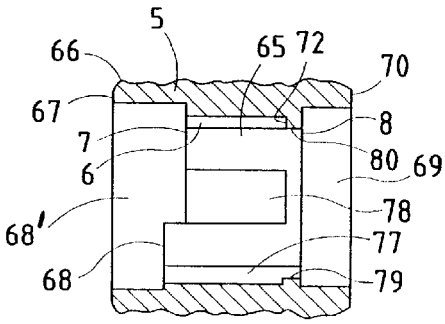
FIG. 10 is an enlarged, cross-sectional view of the barrel.

With reference to FIGS. 5–8, lock housing 4 has a generally rectangular front elevational configuration with rounded corners, and includes a substantially flat marginal portion 38 and a centrally disposed recess 39. In the illustrated example, lock barrel 5 is positioned in a lower area of marginal portion 38, adjacent one corner of recess 39. Lock housing 4 includes a laterally protruding portion 40, which as best shown in FIGS. 12–18A, includes on the interior side thereof, a latch bolt slide 41 and a deadbolt slide 42, which are disposed in a mutually parallel relationship. The recess portion 39 (FIGS. 5–8) of lock housing 4 includes sidewalls 43 with a pair of vertically oriented apertures 43' therein, which serve to pivotally mount a paddle handle 44 within recess 39. As shown in FIG. 7, paddle handle 44 has a generally L-shaped top plan configuration, and includes an actuator tab 45, which extends through a window 46 in the bottom wall 47 of recess 39. Paddle handle 44 also has a generally flat front plate portion 47' shaped to fit within housing recess 39, with a finger recess formed on the interior surface thereof.

Figure 17:
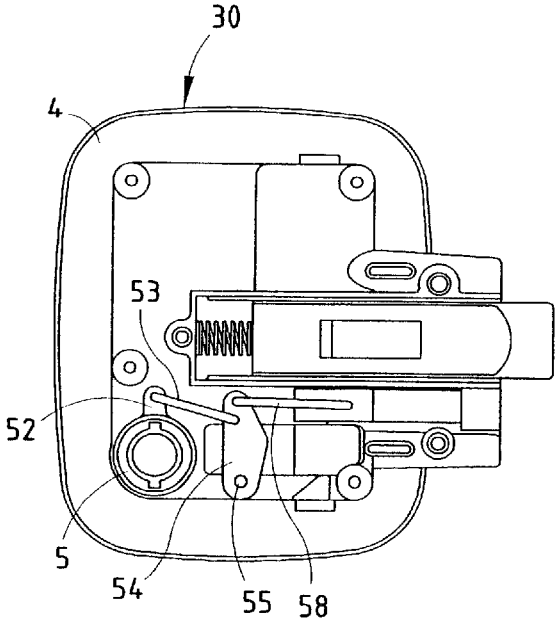
FIG. 17 is a rear elevational view of the latch assembly, wherein the latch bolt is shown in an extended position, and the deadbolt is shown in a retracted position.
Figure 18:
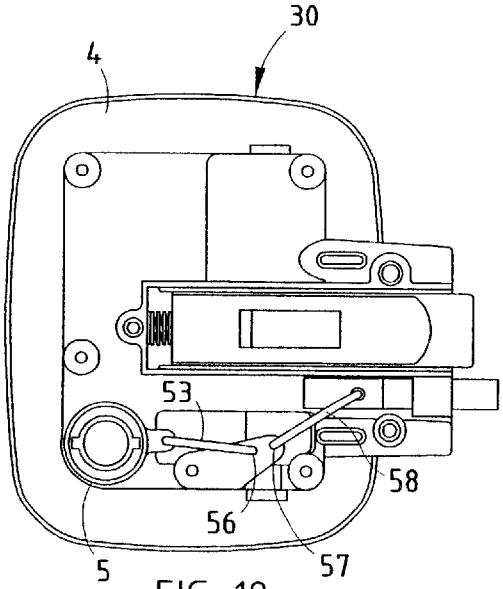
FIG. 18 is a rear elevational view of the latch assembly, wherein the latch bolt is shown in a retracted position, and the deadbolt is shown in an extended position.
Figure 18A:
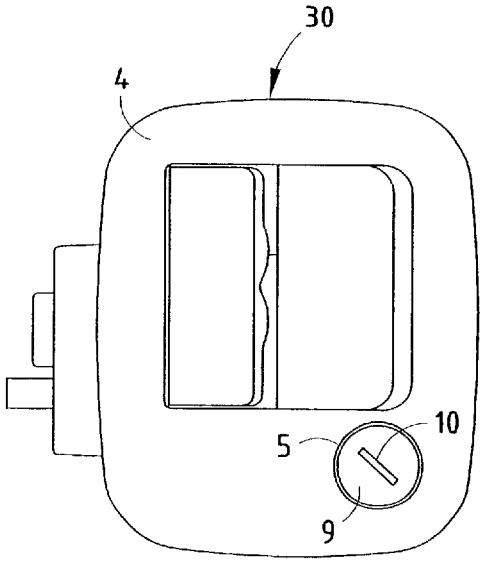
FIG. 18A is a front elevational view of the latch assembly in the position shown in FIG. 18.

As best illustrated in FIGS. 12–18, paddle latch assembly 30 includes a latch bolt 48 that is slidably mounted within latch bolt slide 41 for lateral translation between the extended position shown in FIG. 17, and the retracted position shown in FIG. 18. Latch bolt 48 includes a central window 49 which receives therein the tab 45 of paddle handle 44, such that when paddle handle 44 is rotated, latch bolt 48 shifts longitudinally within latch bolt slide 41. The illustrated paddle latch assembly 30 also includes a deadbolt 50 which is closely received in deadbolt slide 42 for longitudinal shifting between the retracted position shown in FIG. 17, and the extended position shown in FIG. 18. Deadbolt 50 includes a link aperture 51 through the interior end thereof. Deadbolt 50 is shifted longitudinally between its retracted and extended positions by rotation of lock plug 9 relative to lock housing 4 in the following manner. A bell crank 52 (FIGS. 17 and 18) is pivotally supported on lock housing 4 adjacent the inner portion of lock barrel 5. A first link 53 has one end thereof pivotally mounted to bell crank 52. A connector arm 54 is pivotally mounted adjacent its lower end to the rear portion of lock housing 4 by a pin 55, and includes a pair of link apertures 56 and 57 disposed adjacent its upper end, opposite pin 55. First link 53 has its opposite end pivotally mounted in aperture 56 of connector arm 54. A second link 58 has one end pivotally mounted in link aperture 57 on connector arm 54, and its opposite end pivotally connected in the link aperture 51 of deadbolt 50. To shift deadbolt 50 from the fully retracted, unlocked position shown in FIG. 17, lock plug 9 is rotated relative to lock barrel 5, as described in greater detail below, thereby rotating bell crank 52, which in turn rotates connector arm 54 through first link 53, which in turn shifts second link 58 laterally to longitudinally move deadbolt 50 to the fully extended, locked position shown in FIG. 18. In the fully locked position shown in FIG. 18, deadbolt 50 extends through the central window 33 in striker plate 31, thereby positively preventing entry door 3 from being opened. To open entry door 3, a preselected one of the keys 12, 15 and 16 is inserted into the keyway 10 of lock plug 9 to retract selected tumblers 11 to permit lock plug 9 to be rotated back to the unlocked position, as discussed below, which shifts deadbolt 50 back to the unlocked position shown in FIG. 17. Rotation of paddle handle 44 in the manner shown in FIG. 18A retracts latch bolt 48 from the window 33 in striker plate 31, to permit entry door 3 to be opened.

Figure 19:
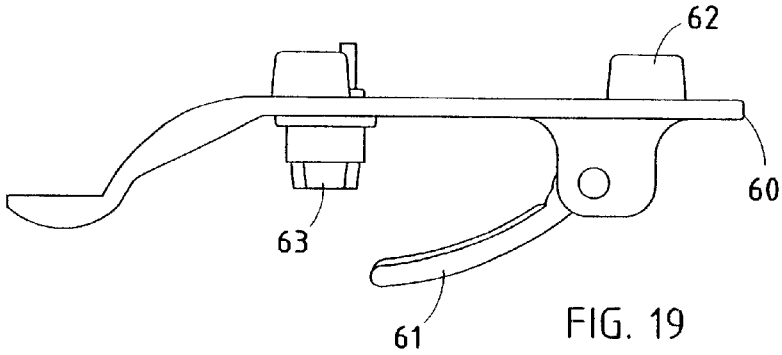
FIG. 19 is a top plan view of a back plate portion of the latch assembly.
Figure 20:
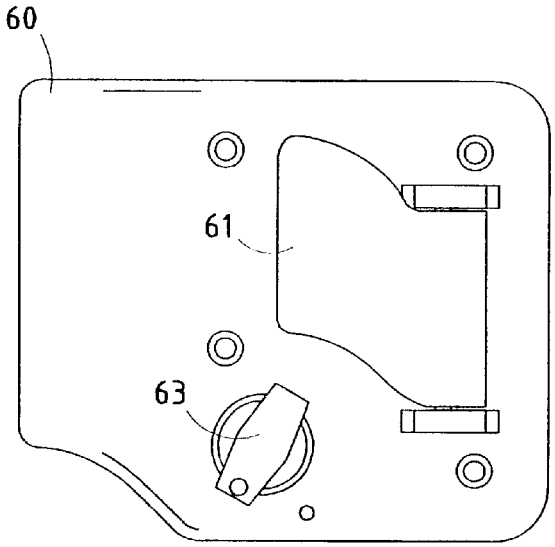
FIG. 20 is a front elevational view of the back plate.
Figure 21:
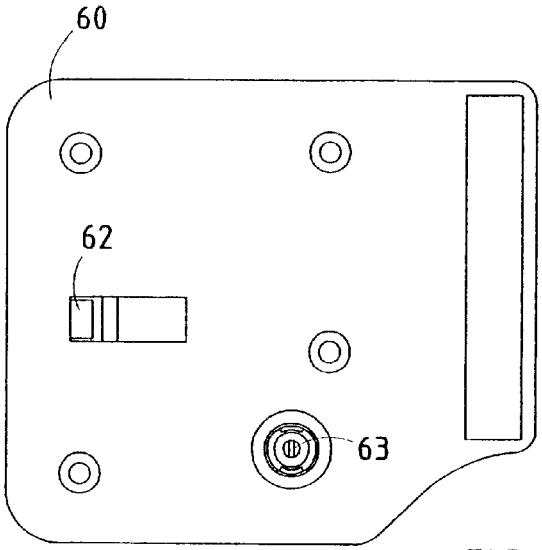
FIG. 21 is a rear elevational view of the back plate.

As best illustrated in FIGS. 19–21, paddle latch assembly 30 includes a back plate 60, which is attached to and encloses the interior side of lock housing 4. Back plate 60 includes a pivotally mounted interior handle 61, having an inwardly protruding tab 62 received in the window 49 of latch bolt 48, such that door 25 can be opened from the interior of the vehicle 2. Back plate 60 also includes a manual deadbolt actuator 63 rotatably mounted thereon. Deadbolt actuator 63 is manually rotated from within the interior of vehicle 2 to shift deadbolt 50 between the locked and unlocked positions.

The illustrated lock barrel 5 (FIGS. 9–11) is integrally formed in lock housing 4, and includes a generally circular interior surface 65 which is formed to define tumbler groove 6, positioner shoulder 7, and keeper shoulder 8. The outermost portion of lock barrel 5 includes a rounded lip 66 which protrudes outwardly from the exterior surface of lock housing 4 and terminates at an outer end 67 of lock barrel 5. A collar shoulder 68 is positioned axially inwardly from outer end 67, and protrudes radially inwardly toward the center of lock barrel 5 a predetermined distance. Collar shoulder 68 defines the base of an associated collar recess 68', which extends from outer collar end 67 to collar shoulder 68. Positioner shoulder 7 is disposed axially inwardly from collar shoulder 68, and also protrudes radially inwardly toward the center of lock barrel 5 a distance similar to that of collar shoulder 68. The inner portion of lock barrel 5 includes a circular recess 69 which defines keeper shoulder 8, and terminates at the inner end 70 of lock barrel 5. Lock barrel 5 also includes a base shoulder 72 which is disposed a predetermined distance axially outwardly from keeper shoulder 8, and is oriented substantially parallel with keeper shoulder 8, as well as positioner shoulder 7 and collar shoulder 68.

Figure 11:
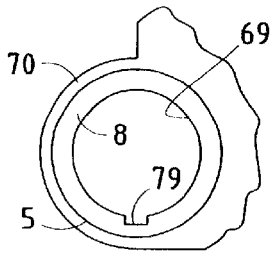
FIG. 11 is an enlarged, rear elevational view of the barrel.
Figure 12:
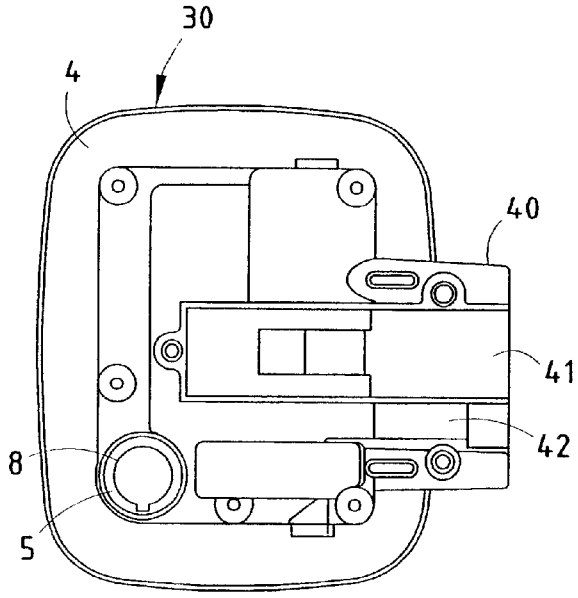
FIG. 12 is a rear elevational view of the latch assembly, wherein selected portions thereof have been removed to reveal internal detail.
Figure 13:
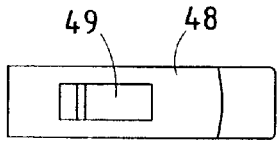
FIG. 13 is a front elevational view of a latch bolt portion of the latch assembly.
Figure 14:
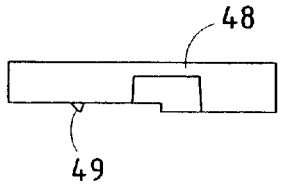
FIG. 14 is a side elevational view of the latch bolt.
Figure 15:
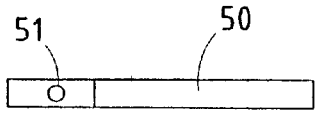
FIG. 15 is a rear elevational view of a deadbolt portion of the latch assembly.
Figure 16:
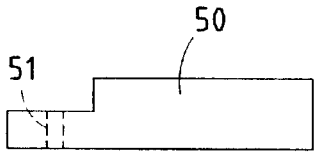
FIG. 16 is a top plan view of the deadbolt.

In the illustrated example, tumbler groove 6 (FIGS. 9–11) extends along the interior surface 65 of lock barrel 5 from positioner shoulder 7 to base shoulder 72. Tumbler groove 6 has radially inclined sidewalls 73 and 74, and an arcuate outer wall 75 disposed concentric with lock barrel 5. As viewed in FIG. 5, tumbler groove 6 is positioned vertically upwardly in a substantially 12 o'clock position on lock barrel 5. The illustrated lock barrel 5 includes three additional grooves 76–78 which are disposed at 90 degree intervals from tumbler groove 6 and are positioned respectively at 3 o'clock, 6 o'clock and 9 o'clock positions on lock barrel 5. Grooves 76–78 have a front elevational configuration that is substantially identical with that of tumbler groove 6. Grooves 76 and 78 extend from positioner shoulder 7 to base shoulder 72 in a manner similar to tumbler groove 6, while groove 77 extends from collar shoulder 68 to base shoulder 72. As best illustrated in FIG. 11, keeper shoulder 8 includes a radially extending locator keyway 79 that is axially aligned with groove 77 and serves to locate lock plug 9 in lock barrel 5 in the manner described in greater detail hereinafter.

Figure 17A:
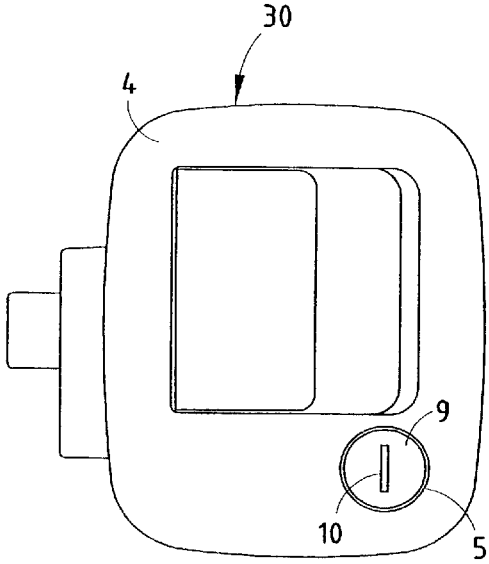
FIG. 17A is a front elevational view of the latch assembly in the position shown in FIG. 17.
Figure 22:
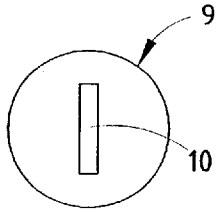
FIG. 22 is a front elevational view of a lock plug portion of the lock system.
Figure 23:
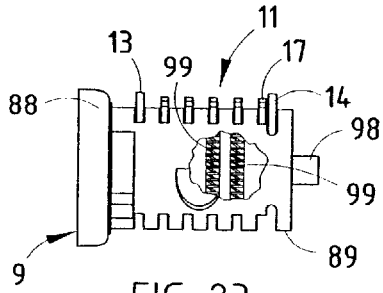
FIG. 23 is a side elevational view of the lock plug, wherein a portion thereof has been broken away to reveal internal construction.
Figure 24:
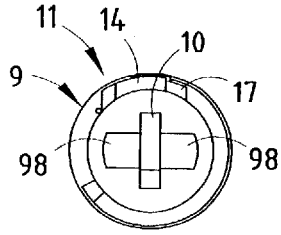
FIG. 24 is a rear elevational view of the lock plug.
Figure 25:
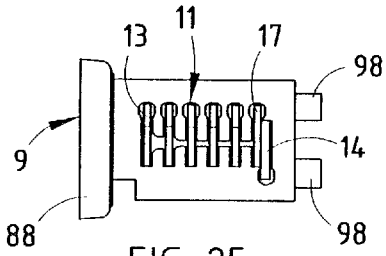
FIG. 25 is a top plan view of the lock plug.
Figure 26:
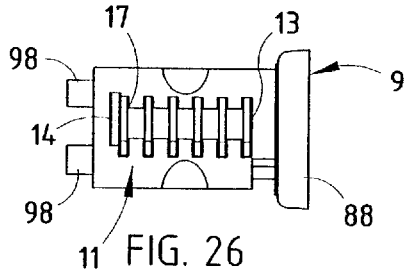
FIG. 26 is a bottom plan view of the lock plug.
Figure 33:
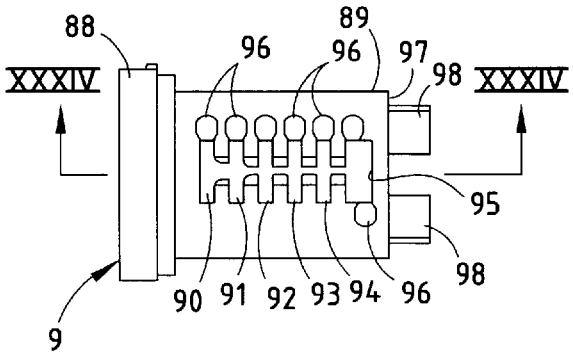
FIG. 33 is a top plan view of a housing portion of the lock plug.
Figure 34:
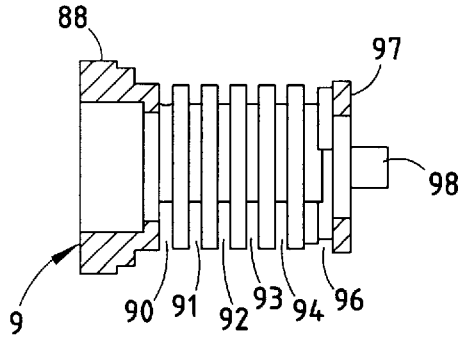
FIG. 34 is a cross-sectional view of the lock plug housing.
Figure 35:
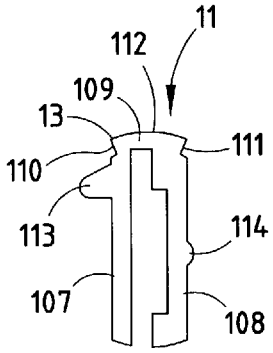
FIG. 35 is a front elevational view of a positioner tumbler portion of the lock plug.
Figure 36:
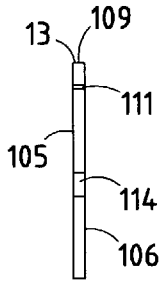
FIG. 36 is a side elevational view of the positioner tumbler.
Figure 37:
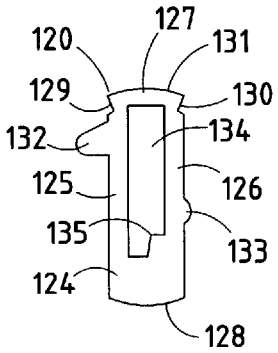
FIG. 37 is a front elevational view of a first lock tumbler portion of the lock plug.
Figure 38:
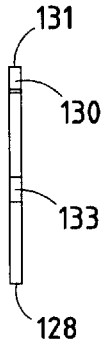
FIG. 38 is a side elevational view of the first lock tumbler.
Figure 39:
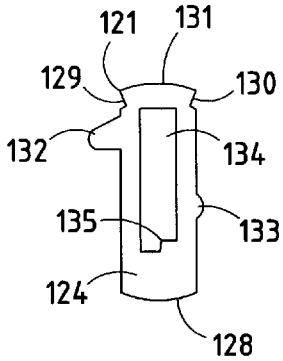
FIG. 39 is a front elevational view of a second lock tumbler.
Figure 40:
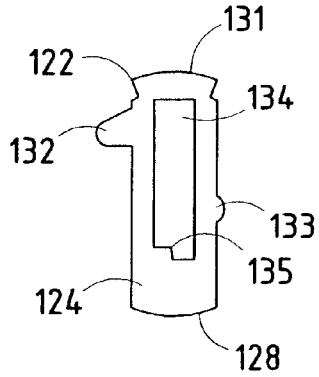
FIG. 40 is a front elevational view of a third lock tumbler.
Figure 41:
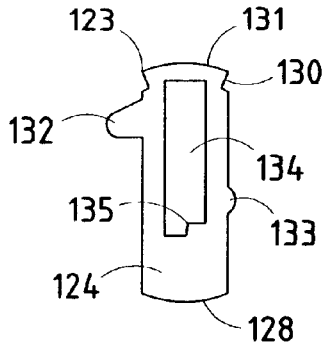
FIG. 41 is a front elevational view of a fourth lock tumbler.
Figure 42:
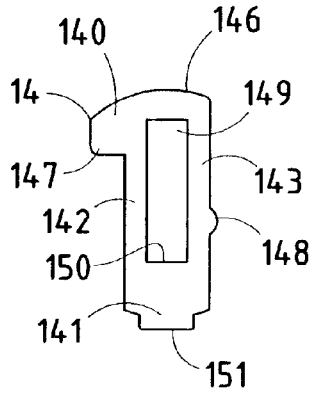
FIG. 42 is a front elevational view of an inner keeper tumbler portion of the lock plug.
Figure 43:
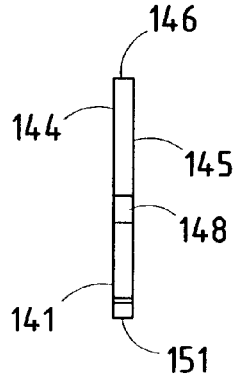
FIG. 43 is a side elevational view of the inner keeper tumbler.
Figure 44:
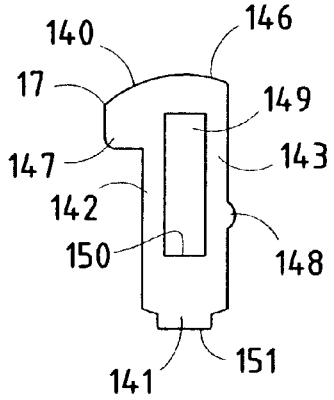
FIG. 44 is a front elevational view of an outer keeper tumbler portion of the lock plug.
Figure 45:
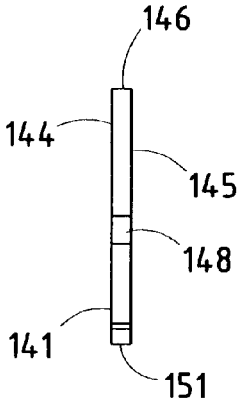
FIG. 45 is a side elevational view of the outer keeper tumbler.

With reference to FIGS. 22–32, the illustrated lock plug 9 has a generally cylindrical shape that is sized for close reception in lock barrel 5, and rotates axially therein between the locked position (FIG. 18A) and the unlocked position (FIG. 17A). As described in greater detail below, the illustrated lock plug 9 is configured to be bodily removed from lock barrel 5 to facilitate repair, re-keying and/or replacement. Lock barrel 5 has a radially protruding outer collar 88 that is sized to be closely received within the collar recess 68' of lock barrel 5. Outer collar 88 has a substantially circular front elevational configuration, with keyway 10 located centrally therein. Lock plug 9 also includes a body portion 89 (FIGS. 33 and 34) with a plurality of radially extending, mutually parallel slots 90–95 that are configured to slidingly mount tumblers 11 therein. As best shown in FIGS. 22–24, keyway 10 extends longitudinally or axially all the way through lock plug 9, and communicates with each of the radially extending slots 90–95 to shift tumblers 11. Slots 90–94 (FIG. 33) are substantially similar in shape, and have a generally rectangular plan configuration, with an ovate spring retaining aperture 96 positioned along one side thereof. Slot 95 is substantially wider than slots 90–94, and includes two spring receiving apertures 96 disposed along opposite sides thereof in an axially staggered relationship for purposes to be described in greater detail hereinafter. The interior end 97 of lock plug 9 includes a pair of axially protruding pawls 98 positioned on opposite sides of keyway 10. Pawls 98 are received in mating recesses in bell crank 52, and serve to rotational connect lock plug 9 and bell crank 52. As best illustrated in FIG. 23, seven longitudinally compressible coil springs 99 are mounted in spring retaining apertures 96, and serve to bias tumblers 11 radially outwardly, as described in greater detail below.

With reference to FIGS. 35–45, tumblers 11 are received within the slots 90–95 of lock plug 9, and are shifted axially by insertion of keys 12, 15 and 16 to control the operation of lock system 1. In the illustrated example, each of the tumblers 11 is a wafer-type tumbler that is biased radially outwardly. Positioner tumbler 13 (FIGS. 35 and 36) has a generally rectangular front elevational configuration with an open base, and includes opposite side faces 105 and 106 disposed in a mutually parallel relationship. Positioner tumbler 13 includes two opposite leg portions 107 and 108, and an arcuately-shaped top portion 109 interconnecting leg portions 107 and 108. Top portion 109 includes radially oriented side edges 110 and 111, and an arcuate top edge 112 which are shaped to be closely received within tumbler groove 6. Leg portion 107 includes an outwardly protruding tab 113, which extends into spring aperture 96 to engage the upper end of an associated spring 99. The opposite leg portion 108 of positioner tumbler 13 includes a laterally extending detent 114 to selectively locate positioner tumbler 13 within slot 90.

The illustrated lock plug 9 includes four key tumblers 120–123, which have a substantially similar construction, and are sized to be slidably mounted in slots 91–94 of lock plug 9. Each of the key tumblers 120–123 has a substantially rectangular front elevational configuration with a closed bottom 124, opposite legs or side portions 125 and 126, and an arcuate top portion 127. The bottom portion 124 of key tumblers 120–123 has an arcuately-shaped end edge 128 that mates with the shape of groove 77 in lock barrel 5. The top portion 127 of key tumblers 120–123 is substantially identical to the top portion 109 of positioner tumbler 13, and includes radially extending side edges 129 and 130 and an arcuate top edge 131 which mate with tumbler groove 6. Like positioner tumbler 13, each of the key tumblers 120–123 includes a tab 132 extending laterally from side portion 125 and protruding into an adjacent one of the spring apertures 96 to engage the upper end of an associated spring 99, and a detent 133 extending from the opposite side portion 126 to selectively locate the key tumblers 120–123 in lock plug 9. Each of the key tumblers 120–123 also includes a central window 134, which is axially aligned with keyway 10 to receive keys 12, 15 and 16 therethrough. Each of the windows 134 has a substantially rectangular plan configuration, and includes a stepped bottom edge 135 which engages bits on keys 12, 15 and 16 to laterally or radially shift tumblers 11. The bottom edges 135 of key tumblers 120–123 are shaped slightly differently to engage specific bits of the various keys, and thereby provide a wide range of key combinations to improve security.

The keeper tumblers 14 and 17 (FIGS. 42–45) are somewhat similar to key tumblers 120–123, except each has an enlarged head or top portion 140 and key-shaped bottom portion 141, which are interconnected by opposite legs or side portions 142 and 143. Keeper tumblers 14 and 17 have flat, mutually parallel faces 144 and 145, and are shaped to be received in a side-by-side relationship within slot 95 of lock plug 9. The top portion 140 of each of the keeper tumblers 14 and 17 has a generally arcuate outer edge 146 which extends laterally to create a tab 147 that protrudes into an associated one of the spring apertures 96 and engages the top edge of an associated spring 99 to bias the same radially outwardly. The opposite side portion 143 of each of the keeper tumblers 14 and 17 includes a laterally extending detent 148 which serves to selectively locate the keeper tumblers 14 and 17 within lock plug 9. Each of the keeper tumblers 14 and 17 has a central window 149 having a generally rectangular plan shape, which is axially aligned with keyway 10 and is designed to receive keys 12, 15 and 16 therethrough. The bottom edge 150 of each keeper tumbler window 149 is flat, unlike the stepped bottom edges 135 of key tumblers 120–123. The bottom portion 141 of each of the keeper tumblers 14 and 17 includes a radially protruding bottom edge 151 having a generally rectangular plan shape that is designed to be closely received within groove 77 of lock barrel 5. As best illustrated in FIGS. 42–45, outer keeper tumbler 14 has an overall height or length that is slightly greater than that of inner keeper tumbler 17 for purposes to be described in greater detail hereinafter.

Lock plug 9 is assembled by first installing coil springs 99 in each of the seven spring retaining apertures 96 in the body portion 89 of lock plug 9. Positioner tumbler 13 is installed in slot 90, so that tab 113 engages the upper end of the associated coil spring 99 to bias the same radially outwardly. Tab 113 engages an adjacent surface in slot 90 to limit the lateral or radial travel of positioner tumbler 13. Key tumblers 120–123 are similarly installed in slots 91–94 of lock plug 9. The tabs 132 of key tumblers 120–123 engage the upper ends of associated springs 99, and detents 133 serve to limit the lateral or radial shifting of key tumblers 120–123 in lock plug 9. Outer keeper tumbler 14 is installed in slot 95 at the interiormost portion thereof, while inner keeper tumbler 17 is installed next to outer keeper tumbler 14 in the interiormost portion of slot 95, such that the same assume a side-by-side relationship. The tab portions 147 of keeper tumblers 14 and 17 engage the upper ends of associated springs 99 to bias the keeper tumblers radially outwardly, while detents 148 serve to limit this axial shifting.

Figure 27:
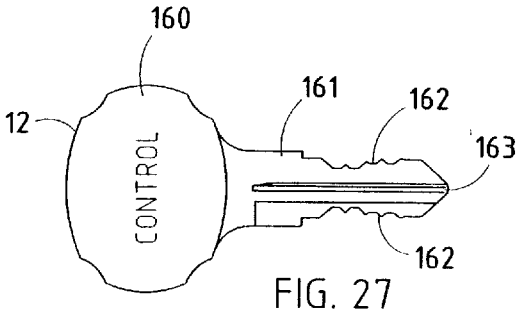
FIG. 27 is a side elevational view of a control key portion of the lock system.
Figure 28:
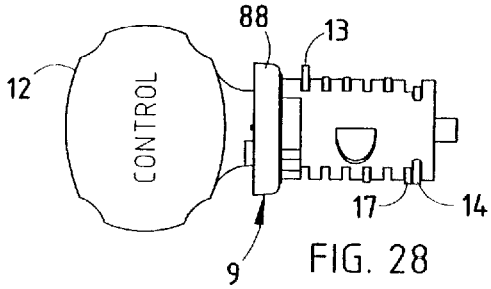
FIG. 28 is a side elevational view of the control key shown inserted into the lock plug.

With reference to FIG. 27, control key 12 has a generally conventional construction, including a generally ovate head portion 160 adapted for grasping, and a longitudinally extending shank portion 161 configured to be closely received within keyway 10. The shank portion 161 of control key 12 includes a plurality of bits 162 on opposite sides thereof, which are adapted to engage tumblers 11 and shift the same radially inwardly to control actuation of lock system 1. In the illustrated example, shank portion 161 includes axially extending ribs 163 to improve security. The length of shank portion 161 of control key 12 is sufficient to extend all of the way through keyway 10, and thereby selectively engage each of the tumblers 11, including both keeper tumblers 14 and 17. Control key 12 is particularly adapted for use by factory and/or service personnel to install, remove, repair and/or re-key lock plug 9, as explained in greater detail below.

Figure 29:
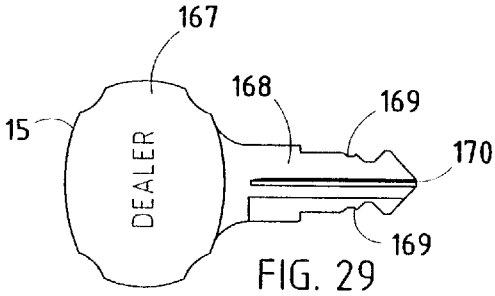
FIG. 29 is a side elevational view of a dealer key portion of the lock system.
Figure 30:
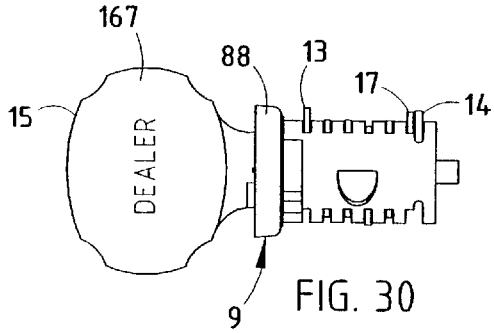
FIG. 30 is a side elevational view of the dealer key shown inserted into the lock plug.

With reference to FIG. 29, dealer key 15 is somewhat similar to control key 12 insofar as it includes a generally ovate head portion 167 adapted for grasping, and a longitudinally extending shank portion 168 that is configured for close reception within keyway 10. The shank portion 168 of dealer key 15 also includes a plurality of bits 169 on opposite sides thereof to selectively shift tumblers 11. Shank portion 168 also includes axially extending ribs 170, which are configured similar to the ribs 163 on control key 12, and mate with the same of keyway 10. The shank portion 168 of dealer key 15 is shorter than the shank portion 161 of control key 12, and is received in keyway 10 a distance only sufficient to engage key tumblers 120–123 and not keeper tumblers 14 and 17, as described in greater detail hereinafter. Dealer key 15 is particularly adapted for use by salespersons and the like, to open the lockable areas of the associated vehicle to show and/or demonstrate the same to a prospective purchaser.

Figure 31:
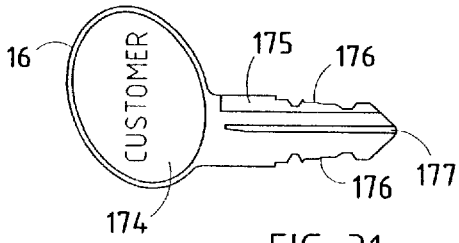
FIG. 31 is a side elevational view of a customer key portion of the lock system.
Figure 32:
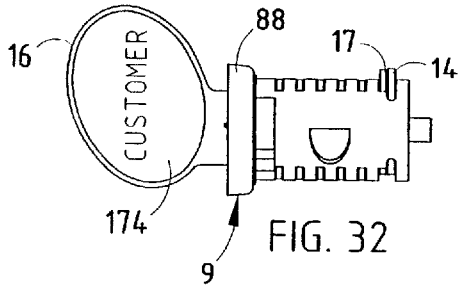
FIG. 32 is a side elevational view of the customer key shown inserted into the lock plug.

With reference to FIG. 31, customer key 16 is somewhat similar to control key 12 and dealer key 15, insofar as it includes a generally ovate head portion 174 adapted for grasping, and a longitudinally extending shank portion 175 configured to be closely received within keyway 10. The shank portion 175 of customer key 16 also includes a plurality of bits 176 on opposite sides thereof which shift tumblers 11 to control operation of lock system 1. The illustrated customer key 16 also includes axially extending ribs 177, which are similar to the ribs 163 and 170 on control key 12 and dealer key 15 respectively, to mate with the shape of keyway 10 and improve lock security. The shank portion 175 of customer key 16 is shorter than the shank portion 161 of control key 12, and extends into keyway 10 a distance which is only sufficient to engage positioner tumbler 13 and key tumblers 120–123, as described in greater detail hereinafter. Customer key 16 is designed to be used by the ultimate purchaser of vehicle 2.

Figure 46:
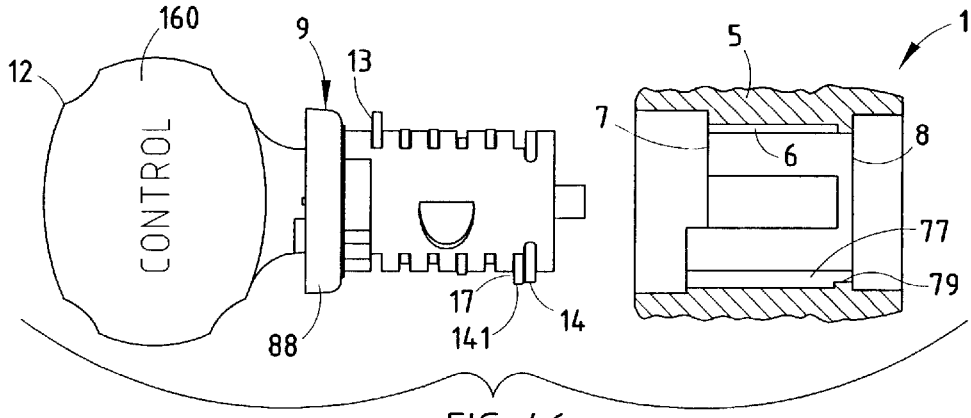
FIG. 46 is a side elevational view of the lock plug with the control key inserted therein, shown prior to assembly in the lock barrel.
Figure 47A:
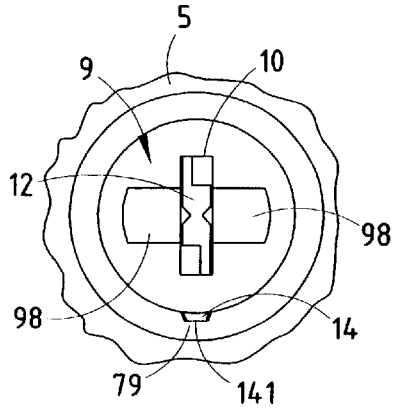
FIG. 47A is an end elevational view of the lock plug and lock barrel assembly shown in FIG. 47.
Figure 48A:
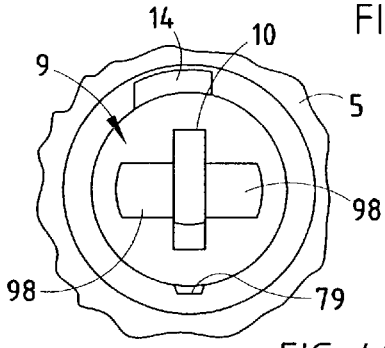
FIG. 48A is an end elevational view of the lock plug and lock barrel assembly shown in FIG. 48.

With reference to FIGS. 46–54, the illustrated lock system 1 operates in the following manner. To install lock plug 9 in lock barrel 5, control key 12 is inserted into keyway 10. The bits 162 on control key 12 retract all of the key tumblers 120–123 and both of the keeper tumblers 14 and 17, but leave the positioner tumbler 13 extended. The retraction of keeper tumblers 14 and 17 causes the key-shaped bottom edges 151 thereof to protrude downwardly or outwardly from lock barrel 5, as shown in FIG. 46. With control key 12 fully inserted into lock plug 9, lock plug 9 is telescoped into lock barrel 5, with the key portions 141 of keeper tumblers 14 and 17 being received within groove 77 of lock barrel 5, as shown in FIG. 47A, to rotationally position lock plug 9, such that key tumblers 120–123 are aligned with tumbler groove 6. Lock plug 9 is inserted into lock barrel 5 until positioner tumbler 13 abuttingly engages positioner shoulder 7, as shown in FIG. 47. Control key 12 is then removed from keyway 10, such that outer keeper tumbler 14 is spring biased radially outwardly for abutting engagement with keeper shoulder 8, as shown in FIGS. 48 and 48A. The abutting contact between positioner tumbler 13 and positioner shoulder 7, as well as outer keeper tumbler 14 and keeper shoulder 8, positively positions lock plug 9 in a first axial position within lock barrel 5. The first axial position of lock plug 9 is shown in FIGS. 47–50. The removal of control key 12 from keyway 10 also causes key tumblers 120–123 to be spring biased outwardly into tumbler groove 6, thereby rotationally locking lock plug 9 in lock barrel 5, and thereby retaining deadbolt 50 in its fully extended locked position. As best illustrated in FIG. 48, inner keeper tumbler 17 is retained in a retracted position by abutting contact with the edge 80 of base shoulder 72.

With reference to FIG. 49, after lock plug 9 has been installed in lock barrel 5, as outlined above, the lock system 1 may be unlocked by dealer personnel, salesmen or the like through the use of dealer key 15. The bits 169 of dealer key 15 are configured to mate with key tumblers 120–123, so that the insertion of the shank portion 168 of dealer key 15 into keyway 10, as shown in FIG. 49, retracts all of the key tumblers 120–123, but leaves the positioner tumbler 13 and the outer keeper tumbler 14 fully extended. Consequently, with dealer key 15 inserted into keyway 10, lock plug 9 can be rotated from the locked position (FIGS. 18 and 18A) to the unlocked position (FIGS. 17 and 17A) to gain entrance to the interior of vehicle 2, or to access a locked storage compartment, or other similar vehicle area. Positioner tumbler 13 and outer keeper tumbler 14 positively retain lock plug 9 in its first axial position (FIGS. 47–50) within lock barrel 5, yet permit selective rotation of lock plug 9 between the locked and unlocked positions. Dealer key 15 operates similar to a master key system, wherein all of the locks can be operated with a single key, even though the lock plugs 9 may have different key codes. This feature permits the vehicle dealer to use one key to unlock or lock every lock on his lot or show area to minimize the management and/or tracking of numerous keys.

Figure 52:
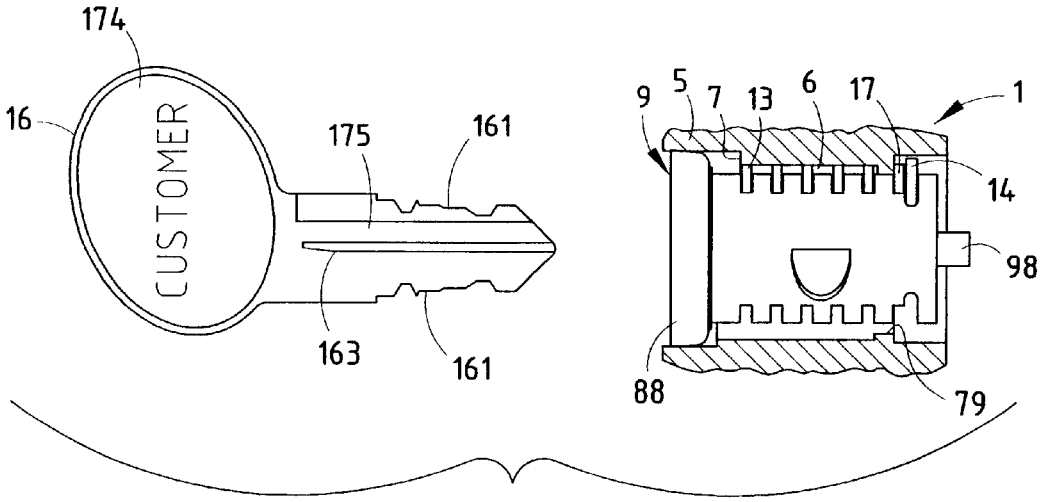
FIG. 52 is a side elevational view of the lock plug in the second axial position in the lock barrel, wherein the customer key has been removed.

After vehicle 2 has been sold to a specific buyer, the purchaser is given a customer key 16 to operate lock system 1. As shown in FIG. 50, the bits 176 on customer key 16 are configured to retract not only each of the key tumblers 120–123, but also the positioner tumbler 13. Lock plug 9 is configured such that the longitudinal or axially directed force applied by the user to insert customer key 16 into keyway 10 and to retract tumblers 13 and 120–123 also shifts lock plug 9 axially inwardly into lock barrel 5 until the outer collar 88 of lock plug 9 engages collar shoulder 68, as shown in FIG. 51, to define a second axial position of lock plug 9 within lock barrel 5. The second axial position of lock plug 9 is shown in FIGS. 51–54. In the second axial position of lock plug 9, as shown in FIG. 51, inner keeper tumbler 17 is spring biased outwardly to engage keeper shoulder 8, such that contact between outer collar portion 88 and collar shoulder 68, and inner keeper tumbler 17 and positioner shoulder 7, positively retains lock plug 9 in the second axial position (FIGS. 51–54). The shifting of lock plug 9 axially from the first axial position shown in FIGS. 47–50 to the second axial position shown in FIGS. 51–54 also shifts positioner tumbler 13 into tumbler groove 6. As best illustrated in FIG. 52, when customer key 16 is removed from keyway 10, key tumblers 120–123, as well as positioner tumbler 13, are biased radially outwardly into tumbler groove 6 to prevent rotation of lock plug 9 relative to lock barrel 5. Both the inner keeper tumbler 17 and outer keeper tumbler 14 remain extended, and serve to positively retain lock plug 9 in the second axial position, yet permit selected rotation of lock plug 9 between the locked and unlocked positions.

Figure 53:
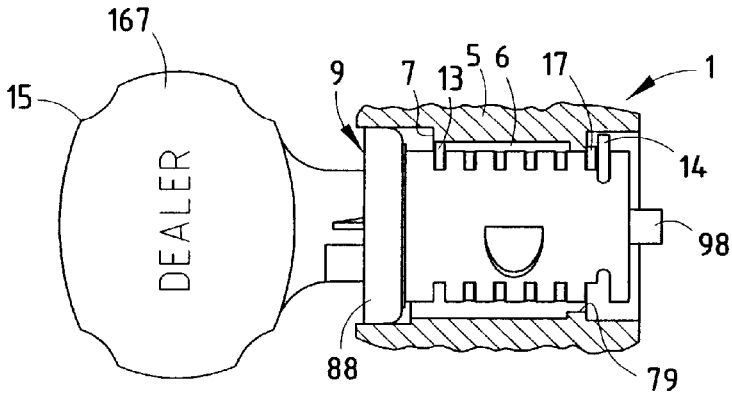
FIG. 53 is a side elevational view of the lock plug in the second axial position in the lock barrel, wherein the dealer key has been inserted into the lock plug.

The axial shifting of lock plug 9 from the first axial position (FIGS. 47–50) to the second axial position (FIGS. 51–54) serves to disable dealer key 15 to provide the customer with security. As shown in FIG. 53, when lock plug 9 is in the second axial position, if a dealer key 15 is inserted into keyway 10, key tumblers 120–123 will be retracted, however, positioner tumbler 13 will remain fully extended within tumbler groove 6, thereby preventing rotation of lock plug 9 relative to lock barrel 5. Hence, dealer key 15 will no longer unlock lock system 1.

Figure 54:
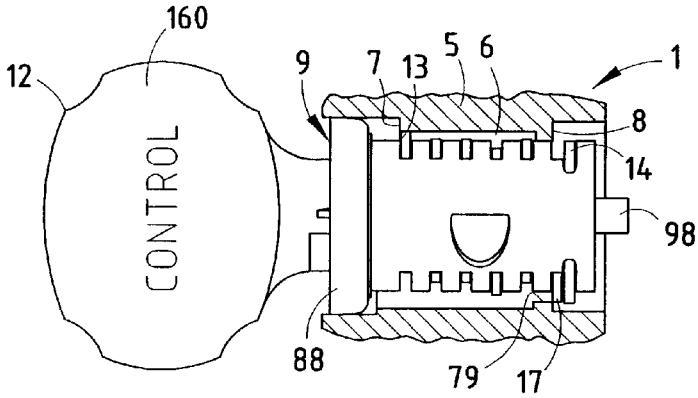
FIG. 54 is a side elevational view of the lock plug in the second axial position in the lock barrel, shown with the control key installed in the lock plug.

With reference to FIG. 54, when lock plug 9 is in the second axial position, it may be removed from lock barrel 5 for repair, re-keying and/or replacement by insertion of control key 12 into keyway 10. As noted above, the bits 162 on control key 12 are configured to retract all of the key tumblers 120–123 and both of the keeper tumblers 14 and 17, but will not retract positioner tumbler 13. However, since positioner tumbler 13 is located within lock barrel 5, the retraction of keeper tumblers 14 and 17 permits the user to axially withdraw lock plug 9 from lock barrel 5. In this manner, lock plug 9 can be readily removed from lock barrel 5 to be repaired, or re-keyed, and subsequently inserted back into lock barrel 5.

The reference numeral 1*a* (FIGS. 55–58) generally designates another embodiment of the present invention, having a modified latch assembly 185. Since lock system 1*a* is similar to the previously described lock system 1, similar parts appearing in FIGS. 1–54 and FIGS. 55–57 respectively are represented by the same, corresponding reference numerals, except for the suffix "a" in the numerals of the latter. In lock system 1*a*, latch assembly 185 has a somewhat simplified construction, comprising a lock housing 186 and a combination handle/latch 187 mounted therein. Latch 185 is particularly adapted for use in conjunction with storage areas associated with recreational vehicle 2, such as exterior storage compartments 24 (FIG. 1). In the illustrated example, hinged doors or closures 25 provide access to the associated storage compartments 24. Latch 185 is preferably mounted adjacent an upper edge of door 25, while the opposite, bottom edge of door 25 is hinged to the trailer body 22, such that door 25 is shifted to its open position by pivoting the door outwardly and downwardly.

Figure 55:
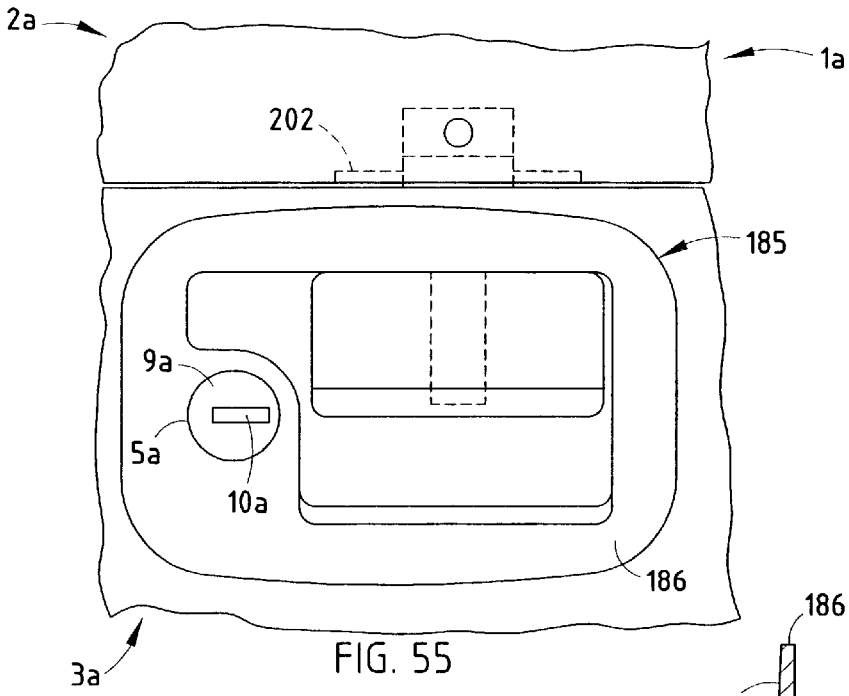
FIG. 55 is a front elevational view of another embodiment of the present invention, wherein the lock system is installed in a latch assembly for a vehicle storage compartment, with the latch assembly shown in a latched position.
Figure 56:
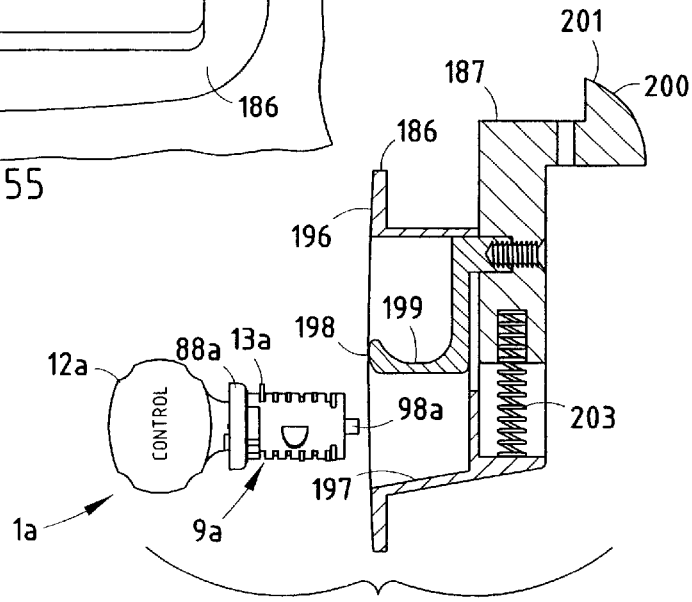
FIG. 56 is a vertical cross-sectional view of the latch assembly shown in FIG. 55, wherein the lock plug with the control key inserted therein has been removed.
Figure 57:
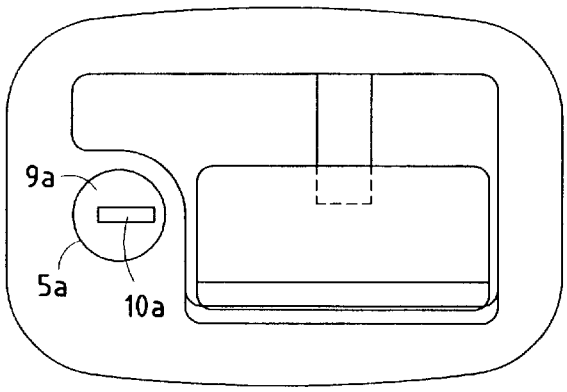
FIG. 57 is a front elevational view of the latch assembly of FIG. 55, shown in an unlatched position.
Figure 58:
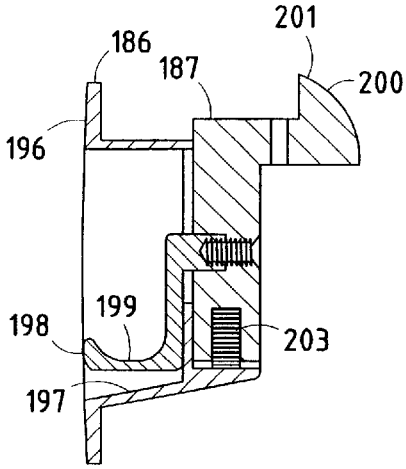
FIG. 58 is a vertical cross-sectional view of the latch assembly of FIG. 55, shown in the unlatched position.

The lock housing 186 of the illustrated latch 185 has a flush mount construction, comprising an exterior flange 196 which is positioned against the outer surface of door 25. Latch housing 186 also includes a central recess 197 in which a combination handle/latch member 187 is slidably mounted. A handle portion 198 of handle/latch 187 includes a finger grip 199 to facilitate shifting the combination handle/latch 187 vertically, as oriented in FIG. 55. Combination handle/latch 187 also includes a latch portion 200 with an outwardly protruding hook or catch 201 that mates with a striker plate 202 on trailer body 22. A coil spring 203 is positioned between latch housing 186 and combination handle/latch 187 to bias combination handle/latch 187 to a normally extended, locked position, as shown in FIGS. 55 and 56. To open latch 185, the operator simply manually grasps finger grip 199, and shifts the same downwardly, against the biasing force of coil spring 203 to the fully retracted or open position shown in FIGS. 57 and 58.

Lock housing 186 includes a lock barrel 5*a*, with a lock plug 9*a* received therein, which are substantially identical to the lock barrel 5 and lock plug 9 described hereinabove. When lock plug 9*a* is in the locked position, the axially extending pawls 98*a* extend into the path of motion of the latch portion 200 of combination handle/latch 187, and thereby prevent combination handle/latch 187 from being shifted to the unlocked position. When lock plug 9*a* is rotated to the unlocked position, pawls 98*a* are shifted out of the path of movement of latch member 200, so that combination handle/latch 187 can be shifted to the open position. Lock plug 9*a* and barrel 5*a* are substantially identical to the above-described lock plug 9 and barrel 5, and use three keys to provide customers and sales personnel with easy access to the lockable storage compartments and/or other areas of numerous vehicles, yet can be readily converted to personalize the locks of a specific vehicle after it is sold to provide the buyer with security.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A lock system for vehicles and the like of the type having at least one entry closure, comprising:

a lock housing adapted for mounting adjacent the entry closure and including a cylindrically-shaped lock barrel with at least one tumbler groove extending axially therealong, a positioner shoulder disposed adjacent to an outer portion of said lock barrel and a keeper shoulder disposed adjacent to an inner portion of said lock barrel;

a cylindrically-shaped lock plug shaped for close reception in said lock barrel for rotation between locked and unlocked positions, and including an axially extending keyway and a plurality of radially shiftable outwardly biased tumblers, comprising at least one key actuated lock tumbler, a positioner tumbler disposed adjacent to an outer portion of said lock plug and inner and outer keeper tumblers disposed adjacent to an inner portion of said lock plug; said lock plug having a first axial position in said lock barrel, wherein said positioner tumbler is positioned for abutting contact with said positioner shoulder, and said outer keeper tumbler is positioned for abutting contact with said keeper shoulder, and a second axial position in said lock barrel, wherein said positioner tumbler is positioned in said tumbler groove, and said inner keeper tumbler is positioned for abutting contact with said keeper shoulder;

a control key having a shank portion thereof shaped for close reception in said keyway with a plurality of bits configured to retract only said lock tumbler and said inner and outer keeper tumblers, thereby leaving said positioner tumbler extended, whereby said lock plug is mounted in said lock barrel by inserting said control key into said keyway, telescoping said lock plug with said control key therein into said lock barrel to said first axial position, wherein said positioner tumbler abuts said positioner shoulder, and removing said control key from said keyway, such that said outer keeper tumbler is biased outwardly for abutting contact with said keeper shoulder to positively retain said lock plug in said lock barrel, yet permit rotating said lock plug between said locked and unlocked positions;

a dealer key having a shank portion thereof shaped for close reception in said keyway with a plurality of bits configured to retract only said lock tumbler, thereby leaving said positioner tumbler and said outer keeper tumbler extended to prevent said lock plug from being removed from said lock barrel, yet permit rotating said lock plug between said locked and unlocked positions; and a customer key having a shank portion thereof shaped for close reception in said keyway with a plurality of bits configured to retract only said positioner tumbler and said lock tumbler, thereby leaving said outer keeper tumbler extended, whereby insertion of said customer key into said keyway retracts said positioner tumbler and shifts said lock plug axially into said second axial position within said lock barrel, wherein said inner keeper tumbler is biased outwardly for abutting contact with said keeper shoulder to positively retain said lock plug in said second axial position within said lock barrel, yet permit rotation of said lock plug between said locked and unlocked positions, and said positioner tumbler is shifted axially into said tumbler groove to prevent rotation of said lock plug by said dealer key to provide customer security.

2. A lock system as set forth in claim 1, wherein:

said lock plug is configured such that the longitudinally directed force applied to said customer key to retract said positioner tumbler and said lock tumbler also shifts said lock plug from said first axial position to said second axial position in said lock barrel.

3. A lock system as set forth in claim 2, wherein:

said lock housing includes a collar shoulder disposed axially outwardly of said positioner shoulder; and said lock plug includes a radially protruding collar which abuts said collar shoulder when said lock plug is in said second axial position to positively retain said lock plug in said second axial position in said lock barrel.

4. A lock system as set forth in claim 3, wherein:

said lock plug is configured to be removed from said lock housing by insertion of the shank portion of said control key into said keyway of said lock plug when said lock plug is in said second axial position in said lock barrel to retract said inner and outer keeper tumblers and permit axial shifting of said lock plug out of said lock barrel for repair or replacement.

5. A lock system as set forth in claim 4, wherein:

said lock plug is configured so that it cannot be removed from said lock housing by said dealer key.

6. A lock system as set forth in claim 5, wherein:

said lock housing includes a bolt which shifts longitudinally between extended and retracted positions to selectively retain the entry closure in a locked position; and said lock plug includes an axially extending lug which operably engages said bolt to shift said bolt between the extended and retracted positions.

7. A lock system as set forth in claim 6, wherein:

said bolt defines a deadbolt.

8. A lock system as set forth in claim 6, wherein:

said lock housing includes a shiftable handle; and said bolt is operably connected with said handle.

9. A lock system as set forth in claim 8, wherein:

said lock plug includes a plurality of said lock tumblers.

10. A lock system as set forth in claim 9, including:

a plurality of said customer keys, each having different bits arranged to mate with a predetermined one of said plurality of lock tumblers.

11. A lock system as set forth in claim 10, wherein:

said lock housing is configured for mounting in the entry closure.

12. A lock system as set forth in claim 1, wherein:

said tumblers comprise spring biased wafer tumblers.

13. A lock system as set forth in claim 1, wherein:

said lock housing includes a collar shoulder disposed axially outwardly of said positioner shoulder; and said lock plug includes a radially protruding collar which abuts said collar shoulder when said lock plug is in said second axial position to positively retain said lock plug in said second axial position in said lock barrel.

14. A lock system as set forth in claim 1, wherein:

said lock plug is configured to be removed from said lock housing by insertion of the shank portion of said control key into said keyway of said lock plug when said lock plug is in said second axial position in said lock barrel to retract said inner and outer keeper tumblers and permit axial shifting of said lock plug out of said lock barrel for repair or replacement.

15. A lock system as set forth in claim 1, wherein:

said lock plug is configured so that it cannot be removed from said lock housing by said dealer key.

16. A lock system as set forth in claim 1, wherein:

said lock housing includes a bolt which shifts longitudinally between extended and retracted positions to selectively retain the entry closure in a locked position; and said lock plug includes an axially extending lug which operably engages said bolt to shift said bolt between the extended and retracted positions.

17. A lock system as set forth in claim 1, wherein:

said lock plug includes a plurality of said lock tumblers.

18. A lock system as set forth in claim 17, including:

a plurality of said customer keys, each having different bits arranged to mate with a predetermined one of said plurality of lock tumblers.

19. A lock system as set forth in claim 1, wherein:

said tumblers comprise spring biased wafer tumblers.

20. A lock system for entry closures and the like, comprising:

a lock housing adapted for mounting adjacent an associated entry closure and including a cylindrically-shaped lock barrel with at least one tumbler groove extending axially therealong, a positioner shoulder disposed adjacent to an outer portion of said lock barrel and a keeper shoulder disposed adjacent to an inner portion of said lock barrel;

a cylindrically-shaped lock plug shaped for close reception in said lock barrel for rotation between locked and unlocked positions, and including an axially extending keyway and a plurality of radially shiftable outwardly biased tumblers, comprising at least one key actuated lock tumbler, a positioner tumbler disposed adjacent to an outer portion of said lock plug and inner and outer keeper tumblers disposed adjacent to an inner portion of said lock plug; said lock plug having a first axial position in said lock barrel, wherein said positioner tumbler is positioned for abutting contact with said positioner shoulder, and said outer keeper tumbler is positioned for abutting contact with said keeper shoulder, and a second axial position in said lock barrel, wherein said positioner tumbler is positioned in said tumbler groove, and said inner keeper tumbler is positioned for abutting contact with said keeper shoulder;

a first key having a shank portion thereof shaped for close reception in said keyway with a plurality of bits configured to retract only said lock tumbler and said inner and outer keeper tumblers, thereby leaving said positioner tumbler extended, whereby said lock plug is mounted in said lock barrel by inserting said first key into said keyway, telescoping said lock plug with said first key therein into said lock barrel to said first axial position, wherein said positioner tumbler abuts said positioner shoulder, and removing said first key from said keyway, such that said outer keeper tumbler is biased outwardly for abutting contact with said keeper shoulder to positively retain said lock plug in said lock barrel, yet permit rotating said lock plug between said locked and unlocked positions;

a second key having a shank portion thereof shaped for close reception in said keyway with a plurality of bits configured to retract only said lock tumbler, thereby leaving said positioner tumbler and said outer keeper tumbler extended to prevent said lock plug from being removed from said lock barrel, yet permit rotating said lock plug between said locked and unlocked positions; and a third key having a shank portion thereof shaped for close reception in said keyway with a plurality of bits configured to retract only said positioner tumbler and said lock tumbler, thereby leaving said outer keeper tumbler extended, whereby insertion of said third key into said keyway retracts said positioner tumbler and shifts said lock plug axially into said second axial position within said lock barrel, wherein said inner keeper tumbler is biased outwardly for abutting contact with said keeper shoulder to positively retain said lock plug in said second axial position within said lock barrel, yet permit rotation of said lock plug between said locked and unlocked positions, and said positioner tumbler is shifted axially into said tumbler groove to prevent rotation of said lock plug by said second key.

21. A lock system as set forth in claim 20, wherein:

said lock plug is configured such that the longitudinally directed force applied to said third key to retract said positioner tumbler and said lock tumbler also shifts said lock plug from said first axial position to said second axial position in said lock barrel.

22. A lock system as set forth in claim 21, wherein:

said lock housing includes a collar shoulder disposed axially outwardly of said positioner shoulder; and said lock plug includes a radially protruding collar which abuts said collar shoulder when said lock plug is in said second axial position to positively retain said lock plug in said second axial position in said lock barrel.

23. A lock system as set forth in claim 22, wherein:

said lock plug is configured to be removed from said lock housing by insertion of the shank portion of said first key into said keyway of said lock plug when said lock plug is in said second axial position in said lock barrel to retract said inner and outer keeper tumblers and permit axial shifting of said lock plug out of said lock barrel for repair or replacement.

24. A lock system as set forth in claim 23, wherein:

said lock plug is configured so that it cannot be removed from said lock housing by said second key.

25. A lock system as set forth in claim 24, wherein:

said lock housing includes a bolt which shifts longitudinally between extended and retracted positions to selectively retain the entry closure in a locked position; and said lock plug includes an axially extending lug which operably engages said bolt to permit shifting said bolt between the extended and retracted positions.

26. A lock system as set forth in claim 25, wherein:

said bolt defines a deadbolt.

27. A lock system as set forth in claim 25, wherein:

said lock housing includes a shiftable handle; and said bolt is operably connected with said handle.

28. A lock system as set forth in claim 27, wherein:

said lock plug includes a plurality of said lock tumblers.

29. A lock system as set forth in claim 28, including:

a plurality of said third keys, each having different bits arranged to mate with a predetermined one of said plurality of lock tumblers.

30. A lock system as set forth in claim 29, wherein:

said tumblers comprise spring biased wafer tumblers.

* * * * *